United States Patent [19]

Wolf et al.

[11] 4,032,102

[45] June 28, 1977

[54] TRAY SUSPENSION MEANS

[76] Inventors: Linda S. Wolf, 44 Loucks Ave., Los Alto, Calif. 94022; Roussel G. Smith, Jr., 1030 Pine St., Menlo Park, Calif. 94025

[22] Filed: May 6, 1976

[21] Appl. No.: 683,738

[52] U.S. Cl. ..... 248/318; 47/67; 248/301

[51] Int. Cl.[2] ..... B42F 13/00

[58] Field of Search ..... D6/113, 137, 182, 183; 47/34.12, 35; 211/71, 113, 115–119, 126; 248/27.8, 317, 318, 301, 303, 304; 240/149; 47/67, 82, 83

[56] References Cited

UNITED STATES PATENTS

| | | | |
|---|---|---|---|
| 288,853 | 11/1883 | Poage | 248/317 X |
| 951,684 | 3/1910 | Gillespie | 47/35 |
| 1,095,504 | 5/1914 | Jannoch | 47/35 |
| 1,204,044 | 11/1916 | McFaddin | 240/149 |
| 1,245,029 | 10/1917 | Robb et al. | 240/149 X |
| 1,344,452 | 6/1920 | Roth | 240/149 X |
| 1,367,638 | 2/1921 | Sweet | 248/318 X |
| 1,414,627 | 5/1922 | Cramer | 248/318 X |
| 1,422,796 | 7/1922 | Spencer | 240/149 |
| 1,443,022 | 1/1923 | Hielscher | 248/318 |
| 1,738,030 | 12/1929 | Bebb | 211/119 X |
| 2,530,456 | 11/1950 | Fracchia | 47/35 X |
| 2,533,845 | 12/1950 | Stender | 248/318 |
| 2,724,568 | 11/1955 | Rabinovitch | 248/301 X |
| 3,854,242 | 12/1974 | Gladstein | 47/35 |
| 3,957,242 | 5/1976 | Holtz | 248/318 |

OTHER PUBLICATIONS

"24 Hanging Planters to Make," Family Circle, June 1975, pp. 88–91.

*Primary Examiner*—Lawrence J. Staab
*Attorney, Agent, or Firm*—Martin E. Gerry

[57] ABSTRACT

Suspension members, terminating in a hangar, have couplers fitted at their other ends for interlocking a tray. Additional couplers provided with additional like suspension members, or similar such members, may be interlocked with the original couplers used to suspend another tray below the first tray, and so on with still more trays in modular suspension configuration possible to provide a hangar for potted plants, for displays for art objects, and the like.

13 Claims, 8 Drawing Figures

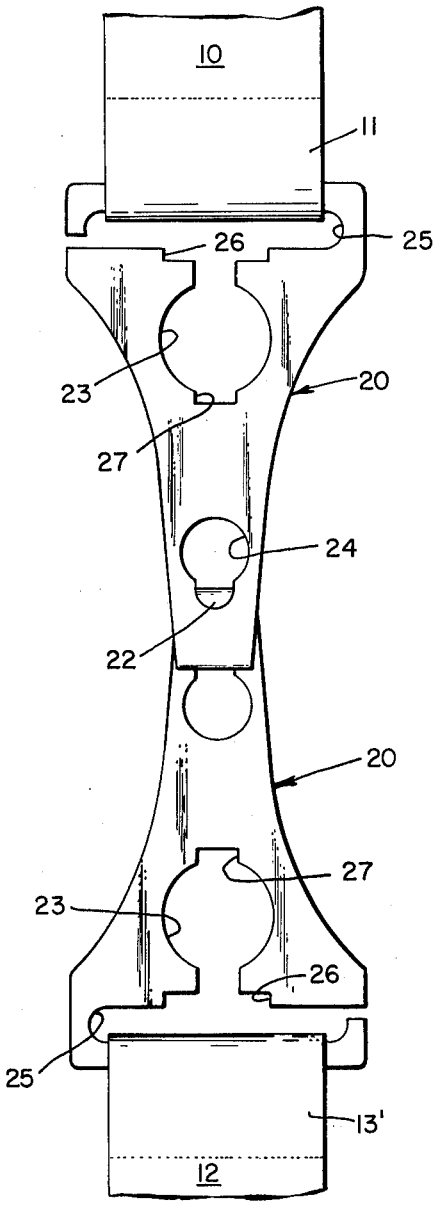
Fig. 5.
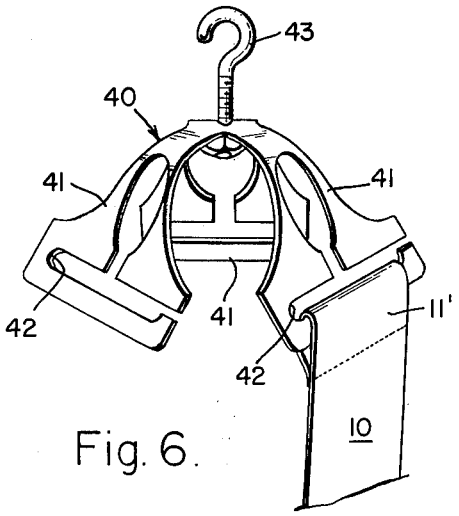
Fig. 6.
Fig. 8.
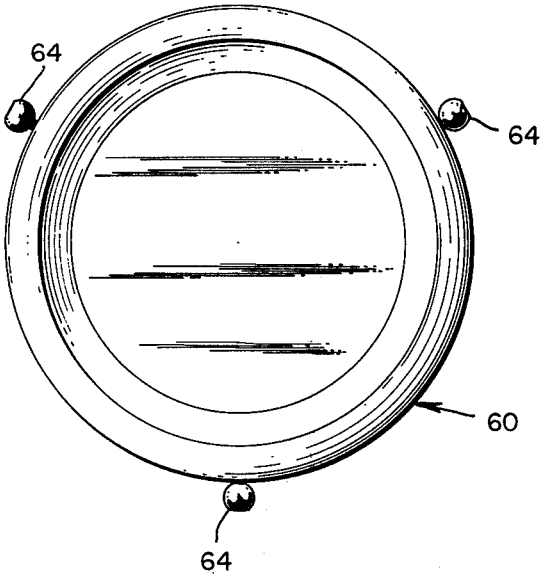
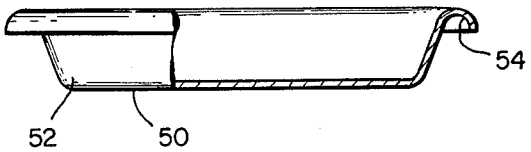
Fig. 7.

TRAY SUSPENSION MEANS

BACKGROUND OF THE INVENTION

This invention is in the field of suspension hangers for potted plants and other similar uses.

Though a variety of hangers exist, the prior art does not provide means for coupling modular configurations of trays, one tray suspended below another, with ease of decoupling when desired.

SUMMARY OF THE INVENTION

A combination of a plurality of suspension members, couplers adapted to the members, and trays interlocked with the couplers is provided including a hanging member acting as a common junction of the members at a point where the combination is suspended.

The trays are provided with either circumferential grooves, circumferential lips or protrusions all of which are readily fitted to the couplers.

Each of the couplers has a slit, an elongated member orthogonal to the slit, apertures in the elongated member for coupling to the trays and a curl at the termination of the elongated member for hooking coupler into apertures of another like coupler.

Multiple sets of couplers can be used to provide a tier of such trays in modular suspension.

BRIEF DESCRIPTION OF THE DRAWINGS

FIG. 5 is an elevation view of a pair of interlocked couplers the elevation face of which is opposite to the elevation face of the interlocked couplers in FIG. 1.

FIG. 6 is a perspective view of the hangar member used as a common junction for the suspension members in accordance with this invention.

FIG. 7 is an elevation view partially in cross section of a different tray usable in lieu of the tray shown in FIG. 1.

FIG. 8 is a plan view of still another tray usable in lieu of the tray shown in FIG. 1.

DETAILED DESCRIPTION

Figure 1:
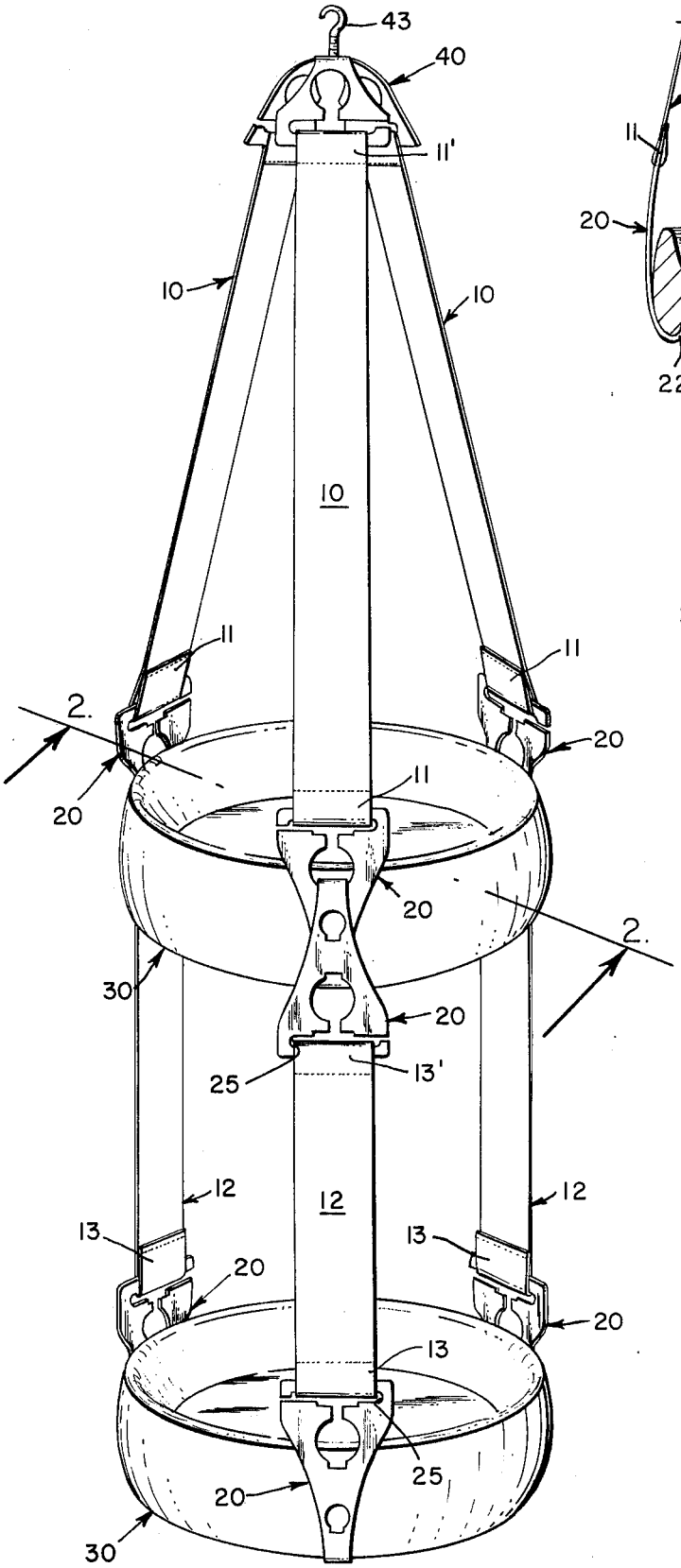
FIG. 1 is a perspective view of a tier of suspended trays in accordance with this invention.
Figure 2:
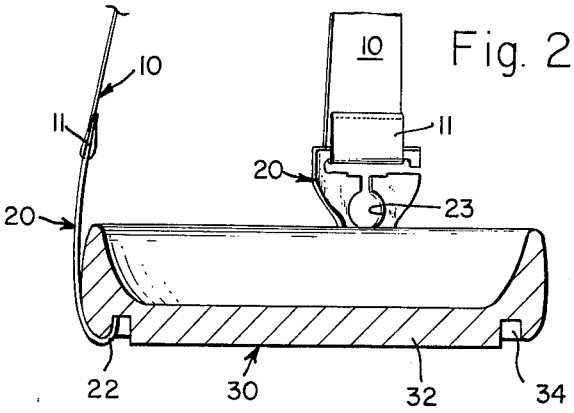
FIG. 2 is a cross section view partially in elevation of one of the trays of FIG. 1 showing a method of interlocking the tray to a set of couplers. The section view is taken at plane 2—2 of FIG. 1.
Figure 3:
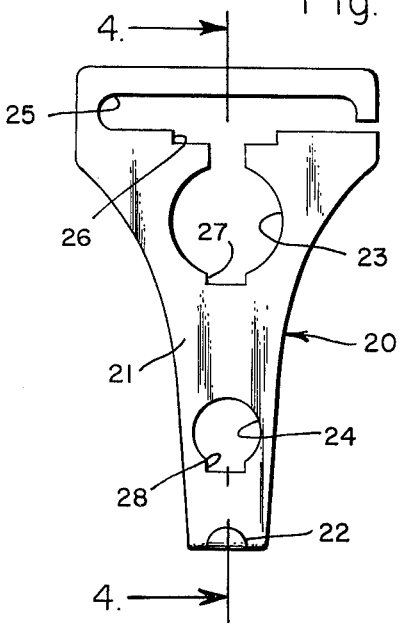
FIG. 3 is an elevation view of one of the couplers in accordance with this invention.
Figure 4:
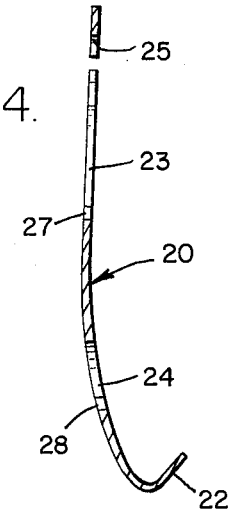
FIG. 4 is a cross section view taken at plane 4—4 of FIG. 3.

Referring to FIGS. 1 through 6, tray suspension means is provided in convenient modular form or singly to be used for supporting objects such as potted plants, as a nick nack display or other like usage.

A plurality of suspension members made of cloth, elastic material, plastic or even metal are provided at 10 and 12. Members 10 are made with loops at their respective extremeties 11 and 11'. Loops at 11 are adapted to couplers 20 by being retained in slots 25 thereof. Loops 11' are adapted to hanger 40 within slots 42 thereof present in each of branches 41 of the hangar. Hangar 40 also has a central hook at 43 adapted to branches 41 so that such hangar may be rotated freely when hook 43 is hung on a fixed support member from which the suspension means is suspended.

Coupler 20, generally metallic, but may be made of any suitable strong material, comprises elongated portion 21 which has apertures 23 and 24 therein. Aperture 23 has notch 27 within the confines of the aperture and aperture 24 has a like notch at 28. Likewise, slit 25 has a similar notch at 26. Notches 26, 27 and 28 are utilized when it is desired to engage two couplers so that curl member 22 at the narrowed terminal end of coupler 20 may be seated in any of these notches of another like coupler.

With reference to FIG. 1, it can be seen that a pair of couplers 20 are interlocked by virtue of curl member 22 of the lower coupler cooperating with and being held in notch 27 of the upper coupler. It is of course obvious that curl 22 of the lower coupler could be seated in either notches 26 or 28 as well. The upper coupler supported in loops 11 are used to suspendably support tray 30 by means of curl portions 22 engaging the peripheral groove 34 in base portion 32 of tray 30.

The lower coupler as shown in FIG. 1, has its curl member 22 seated in notch 27 of the upper coupler. Such lower coupler has loops 13' of suspension members 12 (only one is shown) adapted to elongated slits 25 of the couplers, the other ends of members 12 having loops 13 adapted to like slits 25 of similar couplers 20, which similar couplers are used to support in suspension another tray such as 30 by means of curl members 22 being hooked in peripheral groove 34 at the base of said another tray 30.

In FIG. 5, a pair of couplers as at 20 are shown with their elevation views reversed compared to those seen in FIG. 1, which shows another mode in which such pair couplers may be used.

It is obvious therefore that any number of tiers of trays may be suspended, one tray under another by hooking in curl portions of additional couplers having suspension members such as 12, into any of the notches of the immediately higher elevation positioned couplers.

Referring also to FIGS. 7 and 8, different trays may be suspended by the modular coupling system hereinabove described.

In FIG. 7, tray 50 having a body portion 52 has a lip 54 circumferential the tray. Curl portions 22 of couplers 20 may be used to hook such trays in tandem as was done in the FIG. 1 situation, but substituting trays 50 so that curl portions 22 hook into lip 54 of each of such trays supporting such tray, or trays if more than one tray is used.

In FIG. 8, tray 60 has protrusions 64 peripheral the tray. Protrusions 64 may be used for insertion into either apertures 23 or 24 as desired in order to support the uppermost tray by means of support members 10 adapted to couplers 20 of a modular or tandem tray assembly. The lower trays are likewise supported within apertures 23 or 24 by insertion therein of protrusions 64 of a set of couplers 20 joined by means of support members 12 when the curled portions of couplers 20 are used to interlock the couplers supporting the uppermost tray, in accordance with the method described in connection with FIG. 1.

It is obvious that any of the trays may be suspended in tandem such as suspending tray 50 below tray 30, and tray 60 below tray 50, or any other possible combinations of trays illustrated, or any other trays not shown that have means by which the couplers can be attached thereto.

We claim:

1. A suspension structure comprising in combination:
a plurality of suspension members;
a plurality of couplers engaging said members, each of said couplers has an elongated tapered portion terminating in a curl at the narrowest part thereof and has at least one generally circular aperture in the elongated portion and an elongated open-ended slit in the widest portion thereof in direction orthogonal to the elongated portion;
at least one tray having means integral therewith interlocking with said couplers; and
a hangar secured to said members and providing a common junction for at least some of said members.

2. A suspension structure comprising the combination:
a plurality of suspension members;
a plurality of couplers engaging said members, wherein each of said couplers has an elongated portion terminating in a curl and has at least one aperture in the elongated portion and an elongated slit in direction orthogonal to the elongated portion:
at least one tray having a circumferential groove therein interlocking with said couplers; and
a hangar secured to said members and providing a common junction for at least some of the members.

3. The invention as stated in claim 2, wherein each of said couplers has a notch in said slit and another notch in said at least one aperture.

4. A suspension structure comprising the combination:
a plurality of suspension members;
a plurality of couplers engaging said members, wherein each of said couplers has an elongated portion terminating in a curl and has at least one aperture in the elongated portion and an elongated slit in direction orthogonal to the elongated portion;
at least one tray with a lip circumferential said at least one tray interlocking with said couplers; and
a hangar secured to said members and providing a common junction for at least some of the members.

5. The invention as stated in claim 4, wherein each of said couplers has a notch in said slit and another notch in said at least one aperture.

6. A suspension structure comprising the combination:
a plurality of suspension members;
a plurality of couplers engaging said members, wherein each of said couplers has an elongated portion terminating in a curl and has at least one aperture in the elongated portion and an elongated slit in direction orthogonal to the elongated portion;
at least one tray having a plurality of protrusions peripheral thereof which interlock with said couplers; and
a hangar secured to said members and providing a common junction for at least some of the members.

7. The invention as stated in claim 6, wherein each of said couplers has a notch in said slit and another notch in said at least one aperture.

8. A suspension structure comprising the combination:
a plurality of suspension members;
a plurality of couplers engaging said members, wherein each of said couplers has an elongated portion terminating in a curl and has at least one aperture in the elongated portion and an elongated slit in direction orthogonal to the elongated portion;
at least one tray having means integral therewith interlocking with said couplers, said plurality of couplers comprising multiple sets thereof, a first of the multiple sets being coupled to the means integral and a second of the sets being coupled to the first of the sets; and
a hangar secured to said members and providing a common junction for at least some of the members.

9. The invention as stated in claim 8, wherein each of the couplers has a notch in said slit and another notch in said at least one aperture.

10. The invention as stated in claim 1, wherein said hangar comprises a plurality of branches, each of the branches having a slit for adaptation therein of one of the suspension members.

11. The invention as stated in claim 10, including a swivel member coupled to the hanger.

12. The invention as stated in claim 11, wherein the swivel member is terminated in a hook.

13. A suspension structure comprising the combination:
a plurality of suspension members;
a plurality of couplers engaging said members, each of said couplers has an elongated tapered portion terminating in a curl at the narrowest part thereof and a plurality of apertures in the elongated portion and an elongated open-ended slit in the widest portion thereof in direction orthogonal to the elongated portion;
at least one tray having means integral therewith for interlocking with said couplers; and
another plurality of couplers, identical to and interlocking with said first stated plurality of couplers for engaging like said members.

* * * * *